US009918518B2

(12) United States Patent
Chouinard

(10) Patent No.: US 9,918,518 B2
(45) Date of Patent: Mar. 20, 2018

(54) WADING CRAMPON

(75) Inventor: Yvon Chouinard, Ventura, CA (US)

(73) Assignee: Patagonia, Inc., Ventura, CA (US)

( * ) Notice: Subject to any disclaimer, the term of this patent is extended or adjusted under 35 U.S.C. 154(b) by 1502 days.

(21) Appl. No.: 13/182,354

(22) Filed: Jul. 13, 2011

(65) Prior Publication Data

US 2013/0014409 A1 Jan. 17, 2013

(51) Int. Cl.

| | |
|---|---|
| ***A43C 13/00*** | (2006.01) |
| ***A43C 15/10*** | (2006.01) |
| ***A43B 5/08*** | (2006.01) |
| ***A43B 5/18*** | (2006.01) |

(52) U.S. Cl.

CPC ..... *A43C 15/10* (2013.01); *A43B 5/08* (2013.01); *A43B 5/18* (2013.01)

(58) Field of Classification Search

CPC .... A43B 3/16; A43B 3/18; A43B 3/20; A43B 3/128; A43B 5/08; A43B 5/18; A43C 13/12; A43C 13/02; A43C 13/10; A43C 13/00; A43C 15/10

USPC ..... 36/7.6, 7.1 R–7.8

See application file for complete search history.

(56) References Cited

U.S. PATENT DOCUMENTS 518,923 A * 4/1894 Kilgore ..... A43C 13/02 36/73
1,205,983 A * 11/1916 Emmerth ..... A43B 5/18 36/7.5
1,336,276 A * 4/1920 Brightwell ..... A43C 15/063 36/7.6
1,360,995 A * 12/1920 Anderson ..... A43C 13/12 36/7.5
1,422,683 A * 7/1922 Eltgroth ..... A43C 13/12 36/113
1,676,170 A * 7/1928 Troiel ..... A43B 7/32 36/30 R (Continued)

FOREIGN PATENT DOCUMENTS

| | | |
|---|---|---|
| CH | 185408 A | 7/1936 |
| CH | 195311 A | 1/1938 |
| EP | 233130 A1 | 9/1987 |

OTHER PUBLICATIONS

Simms Alumbite Studs Add to the Traction Options for Vibram Solded Wading Boots, The Caddis Fly: Oregon Fly Fishing Blog, Sep. 16, 2010, 2 Pages, Retrieved from http://oregonflyfishingblog.com/2010/09/16/simms-alumibite-studs-add-to-the-traction-options-for-vibram-soled-wading-boots/.

(Continued)

*Primary Examiner* — Jila M Mohandesi
(74) *Attorney, Agent, or Firm* — Lowe Graham Jones PLLC

(57) ABSTRACT

A non-cleated, soft metal traction device reduces or eliminates slippage on wet and hard surfaces, such as mossy rocks beneath the water surface of a body of water. The traction device includes at least one external metal shank, plate or bar attachable to a footwear item with a desired binding system. The shank is preferably made from a soft metal material, such as a non-heat-treated aluminum alloy, so it is soft enough to grip and elastically conform to moist, wet or otherwise slippery rock and shale. The contact surface of the shank may include grooves, ribs, spaced apart ridges, or other small surface variations to improve the traction of the device in transition environments.

44 Claims, 6 Drawing Sheets

(56) References Cited

U.S. PATENT DOCUMENTS 1,701,611 A * 2/1929 Glidden ..... A43B 13/10 36/30 R
1,811,781 A * 6/1931 Degge ..... A43B 3/16 36/135
2,460,838 A * 2/1949 Meyer ..... A43B 13/08 36/33
2,747,304 A * 5/1956 Linenkohl ..... A43C 15/02 36/72 C
2,928,192 A * 3/1960 Green ..... A43B 13/181 36/28
3,464,127 A 9/1969 Muncie
3,747,237 A * 7/1973 Wilowski ..... A43C 13/04 36/59 C
4,299,037 A * 11/1981 Carey ..... A01B 1/24 36/62
4,344,238 A * 8/1982 Peyser ..... A43C 15/063 36/62
5,836,090 A † 11/1998 Smith
5,950,334 A * 9/1999 Gerhardt ..... A43B 5/18 36/59 R
6,223,459 B1 * 5/2001 Hengstenberg ..... F41C 9/08 42/51
6,742,286 B2 * 6/2004 Giovale ..... A43C 15/061 36/62
6,813,847 B2 11/2004 Workman
7,290,358 B2 * 11/2007 Francis ..... A43B 5/0419 36/132
7,543,399 B2 * 6/2009 Kilgore ..... A43B 3/24 36/101
2003/0226281 A1 * 12/2003 Carlton ..... A43C 15/10 36/7.6
2004/0088883 A1 * 5/2004 Workman ..... A43B 3/18 36/15
2006/0042119 A1 3/2006 Workman et al.
2007/0271816 A1 11/2007 Workman et al.
2008/0250671 A1 10/2008 Walsh et al.

OTHER PUBLICATIONS

International Search Report; dated May 3, 2013; pp. 6.
Black Diamond Ice Climbing 08-09 (catalog excerpt), cover page, contents page, pp. 16-19 and unnumbered pages.†
Dan Bailey's Flies 1974 (catalog excerpt), cover page and p. 38.†
Dan Bailey's Flies 1986 (catalog excerpt), cover page and p. 67.†
Korkers 2009 Dealer Workbook (catalog excerpt), cover page and unnumbered page.†
Black Diamond S2000 (catalog excerpt), cover page and pp. 52-53.†
Black Diamond F2001 (catalog excerpt), cover page, contents page, pp. 6-7 and unnumbered pages.†
Black Diamond F2002 (catalog excerpt), cover page, pp. 10-13 and unnumbered pages.†
Black Diamond Ice & Alpinism 03/04 (catalog excerpt), cover page, pp. 8-11 and unnumbered pages.†
Black Diamond Mountain 2005 (catalog excerpt), cover page and p. 20.†

* cited by examiner
† cited by third party

WADING CRAMPON

FIELD OF THE INVENTION

This invention relates generally to a malleable traction device that is attachable to or integrally formed with a footwear item, and more specifically to a malleable traction device having at least one non-cleated, soft metal shank, plate or bar that reduces or eliminates slippage on wet and hard surfaces.

BACKGROUND OF THE INVENTION

Traction devices used on footwear may come in a variety of forms, such as aggressive tread integrally formed with a sole of the footwear or crampon-style components or systems that are attachable to the footwear. Common mountaineering crampons include cleats or points to improve mobility on snow and ice. Such crampons may be attached using one of three different types of binding systems referred to as step-in, hybrid, and strap bindings.

U.S. Pat. No. 3,464,127 describes a cleated wading sandal having aluminum links to grasp, bite, and prevent slipping on wet, mossy, or slimy surfaces. The links are spaced apart and moveable relative to one another.

SUMMARY OF THE INVENTION

The present invention relates to a non-cleated, soft metal traction device that reduces or eliminates slippage on wet surfaces, such as mossy rocks beneath the water surface of a body of water (e.g., lake, river, stream, etc.). In one embodiment, the traction device includes at least one external metal shank, plate, or bar attachable to a footwear item (e.g., boot or shoe). The shank may be adjustably secured (e.g., crampon-style) to the bottom of the footwear item using straps and brackets. Alternatively, the shank may be permanently fixed to the outer sole of the footwear item. The shank is preferably made from non-heat-treated aluminum, so it is soft enough to grip and elastically conform to minor surface irregularities of moist, wet, or otherwise slippery rock. The contact surface of the shank may include grooves, ribs, spaced apart ridges, or other small surface variations to improve the traction of the device in on approach surfaces leading to the body of water, such as river embankments.

In accordance with an aspect of the invention, a traction device for a footwear item includes a shank attachable to the footwear item; a malleable, soft-metal plate fixed to the shank; and an adjustable binding system coupled to the shank, the binding system configured to secure the shank to the footwear item.

In accordance with another aspect of the invention, a traction device for a footwear item includes a first malleable, soft-metal shank, such as at the forefoot or heel, having opposing surfaces, the first opposing surface for contact with a sole of the footwear item, the second opposing surface being substantially continuous from front-to-back and from side-to-side; and a binding system coupled to the shank, the binding system adjustably securable to the footwear item.

In accordance with yet another aspect of the invention, a traction device for a sole of a footwear item includes a first bar having a first surface in contact with the sole and a second, opposing surface made from a malleable, soft-metal material; a second bar having a first surface in contact with the sole and a second, opposing surface made from a malleable, soft-metal material; and fastening devices for securing the first and second bars to the sole of the footwear item.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

As will be described in further detail below, a traction device for a footwear item includes malleable, soft-metal shanks that may be adjustably coupled together with a connecting bar. The traction device may be attached to the footwear with optional binding systems such as, but not limited to, a strap-type binding system, a step-in binding system, or a hybrid binding system. The traction device may advantageously operate in the linear elastic range and thus resiliently conform via compressive deformation to wet, hard surfaces such as submerged rocks or hard river beds. The malleable nature of the shanks permits the traction device to "grab" wet rocks even when such rocks are covered with mold, algae, wet leaves, etc.

Figure 1:
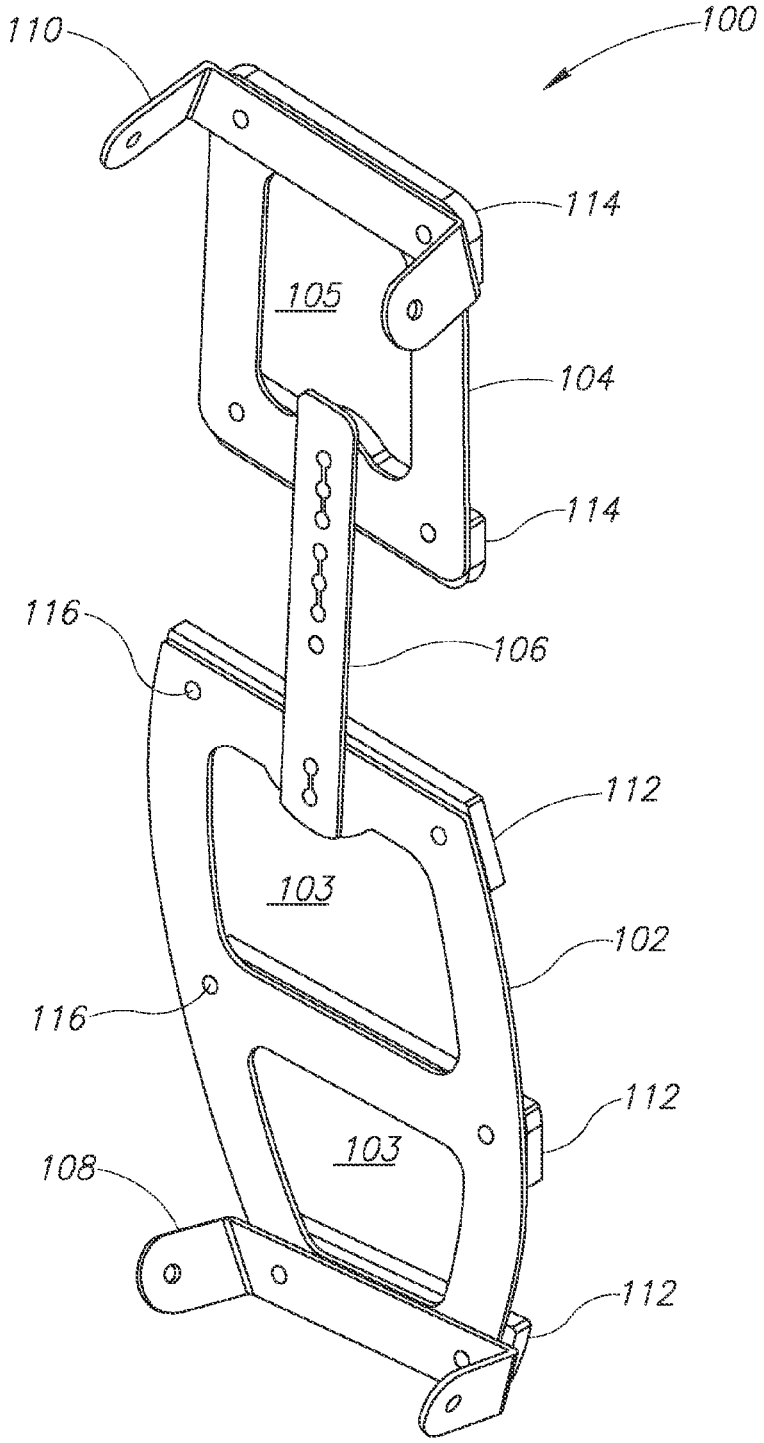
FIG. 1 is a perspective view of a traction device having malleable bars fixed to toe and heel shanks according to an embodiment of the present invention.
Figure 2:
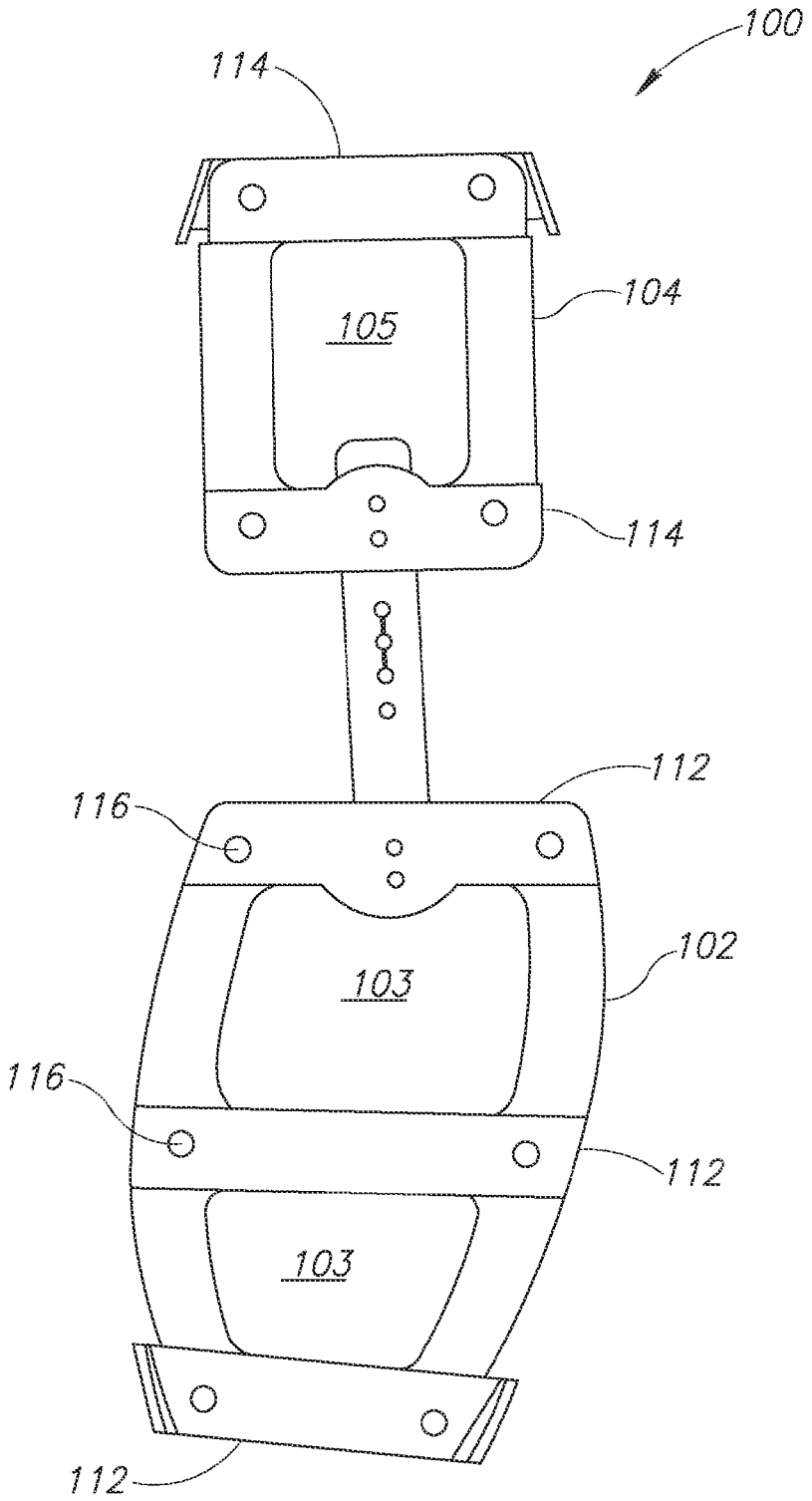
FIG. 2 is a bottom plan view of the traction device of FIG. 1.
Figure 4:
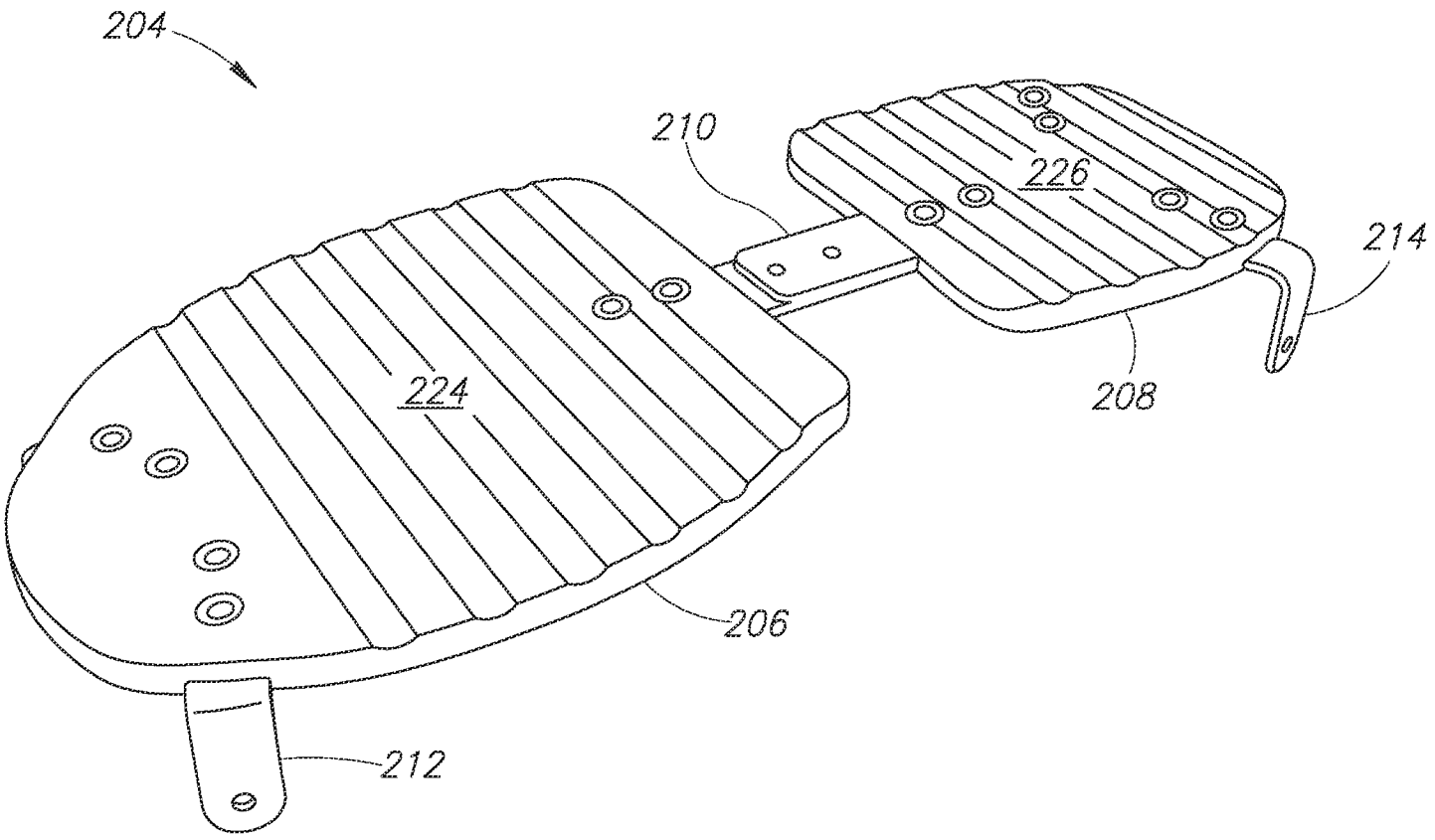
FIG. 4 a perspective view of the traction device of FIG. 3 having a front shank and a heel shank according to an embodiment of the present invention.

FIGS. 1 and 2 show a traction device 100 having a toe shank 102 coupled to a heel shank 104 using a connecting bar 106. The toe shank 102 may include one or more openings 103 to reduce the overall weight of the toe shank 102. Likewise, the heel shank 104 may include one or more openings 105 to reduce its weight. The traction device 100 may further include at least one front bracket 108 and at least one rear bracket 110 configured to work with a binding system such as, but not limited to, a strap-type binding system. Coupled to an underside of each shank 102, 104 are malleable, soft-metal bars, plates or members 112, 114, respectively, that are spaced apart from each other. The bars, plates, or members 112, 114 can each extend from one side to the other side of the shank 102, 104 (and/or sole of a footwear item), and can be longitudinally parallel and spaced apart relative to each other, as shown in FIG. 1, such that a portion of the shank 102, 104 (and/or sole of a footwear item) is disposed between each bar, plate, or members 112, 114, respectively. Each bar, plate, or member 112, 114 can comprise a ground contact perimeter edge (e.g., comprising the four side edge surfaces of bar 112) that extends substantially vertically from the sole of a footwear item (and/or the shank 102, 104) toward the ground contact surface of the respective bar, plate, or member 112, 114. As shown in FIG. 1, for example, the ground contact perimeter edge extends laterally around the entire perimeter of each bar, plate, or member 112, 114 for gripping the terrain about the ground perimeter edge (e.g., to grip gravel, boulders, dirt, etc.). In some examples, such ground contact perimeter edge comprises a plurality (e.g., four) substantially planar side edge surfaces (e.g., like bar 112), or it can comprise a plurality of non-linear and/or variable side edge surfaces that define the ground contact perimeter edge (e.g., see the lower bar 114 of FIG. 1 that has transition side edges surfaces near arch plate 106). See also FIG. 4, showing plate 206 (or 208) having a ground contact perimeter edge that extends laterally around the entire perimeter of the plate 206, and that comprises curved and flat side edge surfaces that collectively define the ground contact perimeter edge of the plate 206 (e.g., see the side edge of "thickness portion 240" of FIG. 6). The members 112, 114 are preferably removable and replaceable with respect to the shanks 102, 104 and/or a sole of a footwear item. In one embodiment, the members 112, 114 are riveted to the shanks 102, 104 or the sole with flush-head type rivets 116. The rivets 116 may be drilled or punched out when any of the members 112, 114 requires replacement. The members 112, 114 may be made from a non-heat treated aluminum alloy material or a copper alloy material. Preferably, the members 112, 114 are also made from an anti-corrosive material. The shanks 102, 104, on the other hand, may be made from a harder metal or plastic to provide a structurally robust framework for receiving the members 112, 114.

Further, the illustrated embodiment shows three members 112 coupled to the toe shank 102 and two members 114 coupled to the heel shank 104; however either shank may have a greater or lesser number of members. And, the members 112, 114 may be arranged in a variety of patterns and directions depending on the uses of the fraction device or the needs of the customer.

Figure 3:
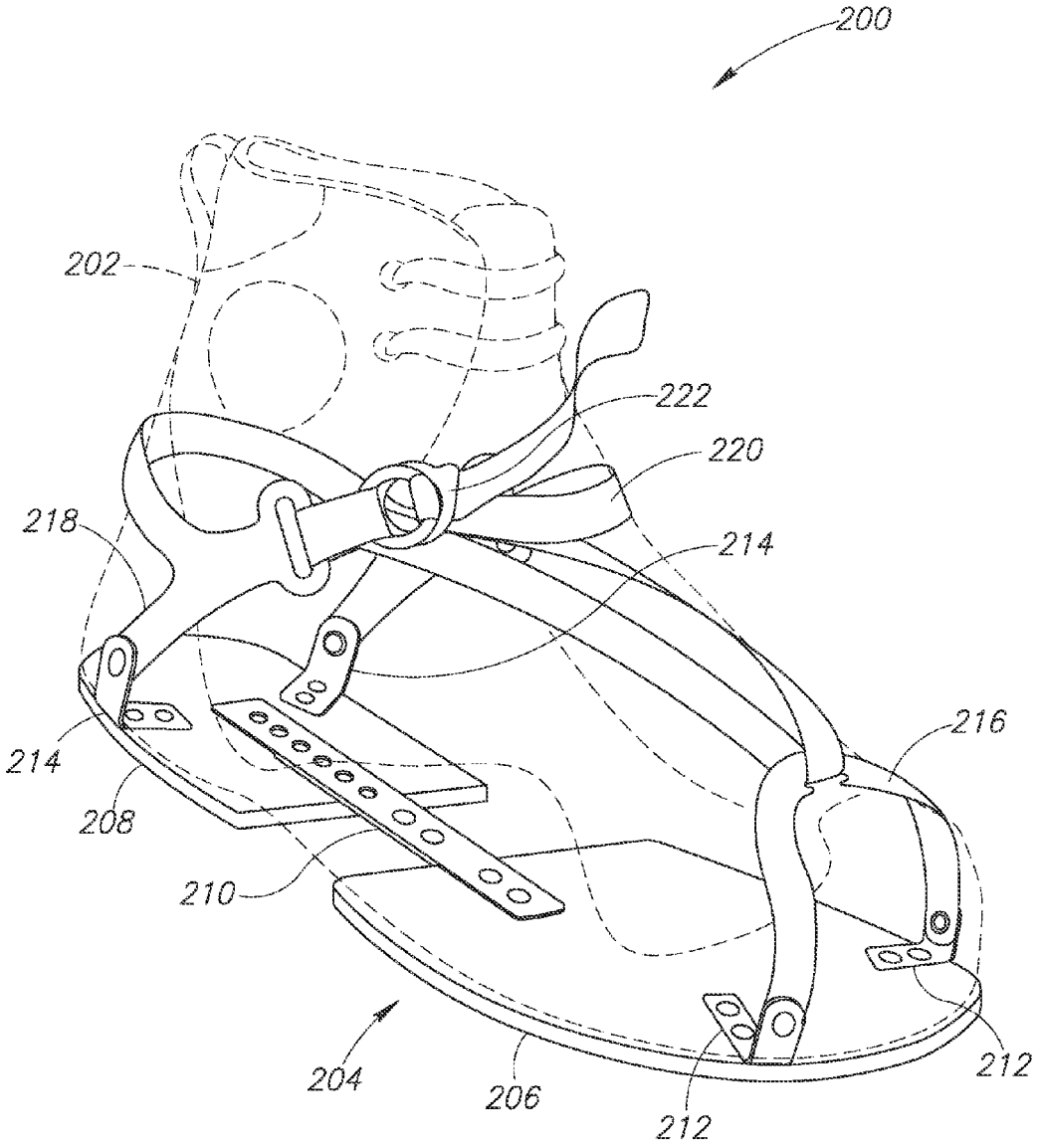
FIG. 3 is a perspective view of a footwear item having a traction device strapped thereto according to an embodiment of the present invention.

FIG. 3 shows a traction system 200 having a footwear item 202 coupled to a traction device 204. In the illustrated embodiment, the footwear item 202 takes the form of a wading boot, but may take any form capable of receiving the traction device 204. The traction device 204 includes a front shank 206 and a heel shank 208 coupled together with a connecting bar 210. While the connecting bar 210 is illustrated as a rigid, structural member, it is well known to provide a hinge that allows the front shank 206 to rotate relative to the heel shank 208. The traction device 204 includes front brackets 212 and heel brackets 214 affixed to the front and heel shanks 206, 208, respectively. One or more of the brackets 212, 214 may take the form of an L-shaped bracket. Front and heel attachment members 216, 218 are coupled to the front and heel brackets 212, 214, respectively. The attachment members 216, 218 may be semi-rigid and configured to conformingly receive the footwear item 202. A strap or webbing 220 and cinching buckle 222 may be arranged, adjusted, and tightened to secure the traction device 204 to the footwear item 202.

Optionally the traction device 204 may be attached to the footwear item 202 using step-in type clips and bails that lock into place on the front and rear welts of the footwear item. A hybrid binding system includes a rear bail with a lever and flexible front strap, which requires the footwear item to have a rear welt, but does not require a front welt. Nevertheless, the strap-type binding system is most preferable because it allows the traction device to be tightly and securely attached to a variety of footwear items independent of front and rear welts.

FIG. 4 shows the traction device 204 from an underside perspective. The front shank 206 includes a front contact surface 224 that is substantially continuous from front-to-back and from side-to-side. Likewise, the heel shank 208 includes a heel contact surface 224 that is substantially continuous from front-to-back and from side-to-side. In one embodiment, the shanks 206, 208 are made from a malleable, soft metal material, such as a non-heat treated aluminum alloy material or a copper alloy material. Preferably, the shanks 206, 208 are also made from an anti-corrosive material. In another embodiment, the shanks 206, 208 are made from a malleable plastic or rubber embedded with soft metal fibers, shavings, or chunks. Preferably, the shank contact surfaces 224, 226 are uncoated and uncovered because coatings can wear, flack off and enter natural water systems. Coatings can also diminish the traction of the soft metal onto the rocky, wet surfaces. Coverings, such as felt for example, are also undesired because such coverings can house and transfer microbial life from one ecosystem to another.

Figure 5:
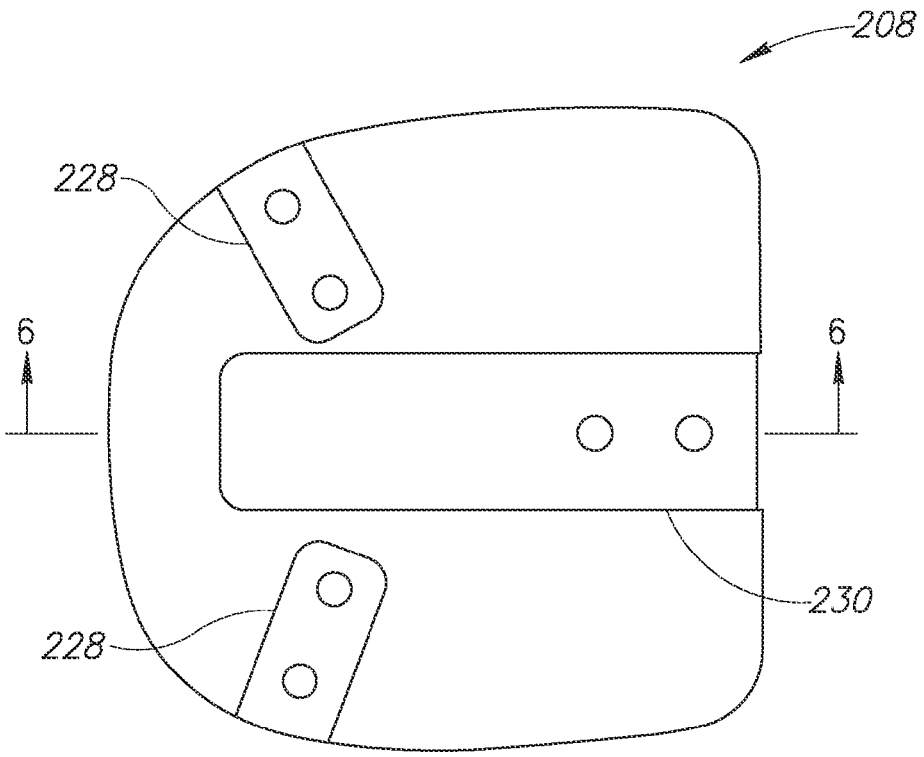
FIG. 5 is a top plan view of the heel shank of the traction device of FIG. 4.
Figure 6:
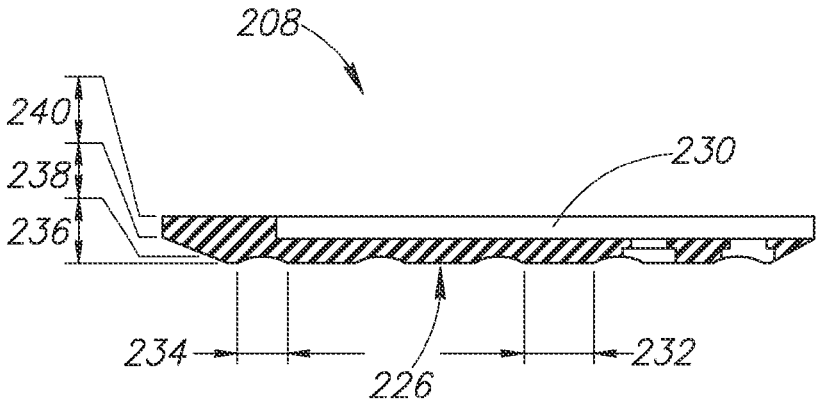
FIG. 6 is a cross-sectional view of the heel shank of FIG. 5 taken along line 6-6 of FIG. 5.

FIG. 5 shows the heel shank 208 with bracket recesses 228 and a connecting bar recess 230. The front shank 206 may include similar features. FIG. 6 shows the heel shank 208 in which the heel contact surface 226 includes relatively flat portions 232 spaced apart by grooves or ridges 234. The grooves 234 may have a relatively shallow depth 236 a thickness 238 beneath the recesses 228, 230 and an increased thickness portion 240 adjacent the recesses 228, 230. The grooves 234 are optional (i.e., the contact surfaces 224, 226 may be planar), but it is appreciated they may be more aggressive or more shallow depending on different traction needs. For example, more aggressive grooves may provide better traction on dry surfaces or wood surfaces; whereas more shallow grooves may provide better traction on wet, hard surfaces. In any case, the external surface grooves, ribs, or other projections are preferably not so extensive as to substantially interfere with the bottom of the shank conformably gripping to the small bumps, rough surface, or irregularities of the underwater surface, such as rocks.

Figure 7:
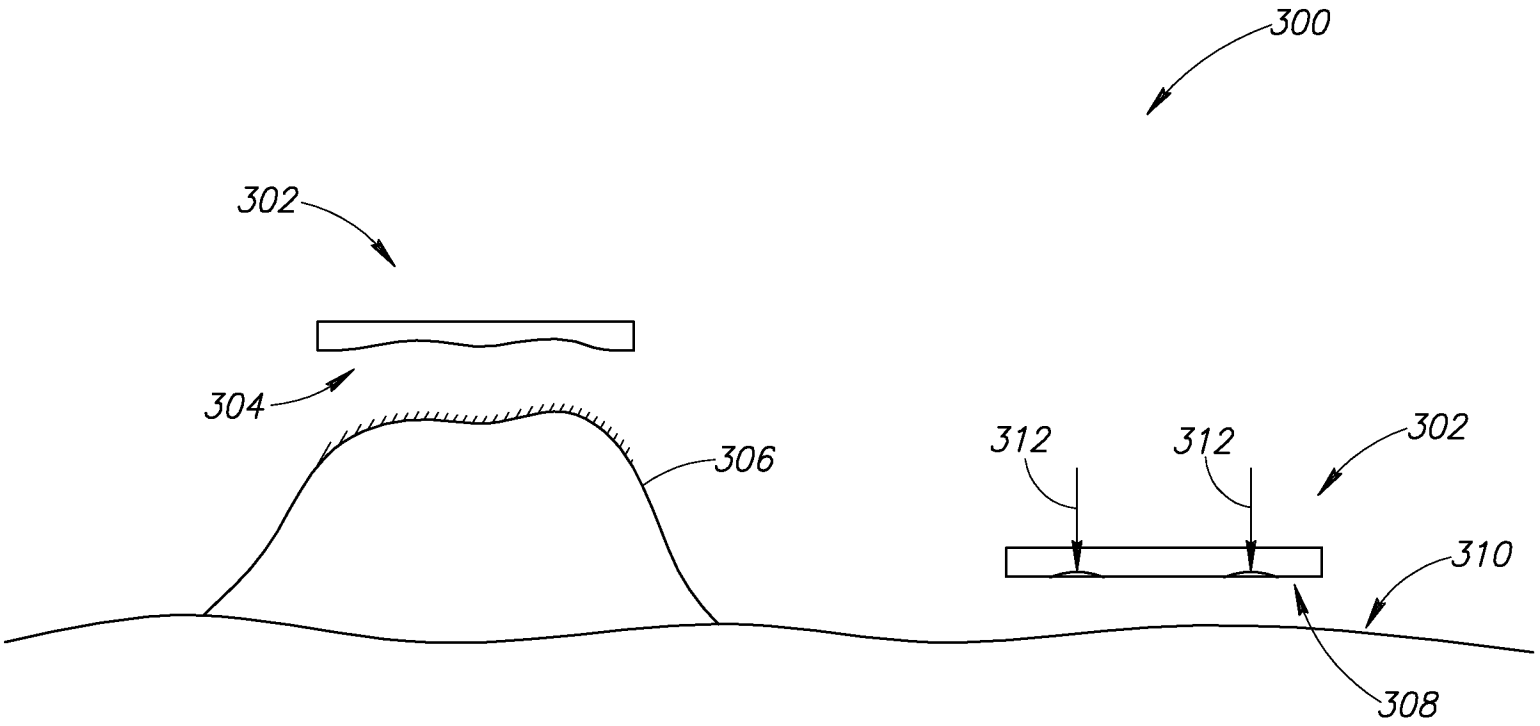
FIG. 7 is a schematic view of a traction device approximately deforming on a wet, hard surface and elastically restoring to a pre-deformed state according to an embodiment of the present invention.

FIG. 7 schematically shows an environment 300 in which a traction device 302 adapts to a deformed shape 304 while in contact with a wet, hard object 306 and resiliently reestablishes its original shape 308, but with some amount of yielding, when placed on a softer and/or flatter surface 310. The downward-directed arrows 312 indicate the portions of the traction device 302 that may yield and become permanently deformed after moving off of the hard object 306. However, these portions may also spring back to their pre-deformed shape in some instances, for example when the loads on the traction device 302 are not large enough to cause yielding. The illustrated deformation has been purposefully exaggerated for purposes of clarity. In operation, the traction device 302 advantageously reduces or eliminates slippage on wet, hard surfaces. The shanks of the device 302 are preferably made from non-heat-treated aluminum, so they are soft enough to grip by slightly deforming on the small irregularities on rocks and other hard surfaces even when wet, mossy or otherwise slippery. The contact surface of the shank may include grooves, ribs, spaced apart ridges, or other small indentations to improve the traction of the device in the areas approaching the water environment 300. Notably however, the traction devices described herein are not spiked or cleated like one that would be used for mountaineering or ice climbing.

While the preferred embodiments of the invention has been illustrated and described, as noted above, many changes can be made without departing from the spirit and scope of the invention. Accordingly, the scope of the invention is not limited by the disclosure of the preferred embodiment. Instead, the invention should be determined by reference to the claims that follow.

The embodiments of the invention in which an exclusive property or privilege is claimed are defined as follows:

1. A traction device for a footwear item, the device comprising:

a toe shank and a heel shank attachable to the bottom of a footwear item, the toe shank and the heel shank coupled together by an arch plate;

a malleable, soft-metal plate fixed to each of the toe shank and the heel shank, the plate being generally flat, wherein the plate is deformable when in contact with minor terrain irregularities, and wherein the plate does not have any projections that extend downwardly from the plate as to substantially interfere with the bottom of the plate conformably gripping the terrain, and wherein the plate comprises a ground contact perimeter edge that extends laterally around the entire perimeter of the plate for gripping the terrain about the ground contact perimeter edge, and wherein the plate includes a plurality of grooves extending laterally from one side of the ground contact perimeter edge to another side of the ground contact perimeter edge; and an adjustable binding system coupled to the shank, the binding system configured to secure the shank to the footwear item.

2. The traction device of claim 1, wherein the plate is a bar.

3. The traction device of claim 2, further comprising another malleable, soft-metal bar fixed to one of the toe shank or heel shank, wherein each malleable, soft metal bar comprises a ground contact surface being generally flat and parallel to at least one of the toe shank and heel shank.

4. The traction device of claim 1, wherein each shank includes at least one opening.

5. The traction device of claim 1, wherein the plate extends from side-to-side of each of the first and second shanks.

6. The traction device of claim 5, wherein the plate on each of the first and second shanks are substantially parallel relative to each other.

7. The traction device of claim 1, wherein each shank is made from a harder material than the soft-metal plate.

8. The traction device of claim 1, wherein the plurality of grooves are spaced apart from each other by a plurality of flat portions.

9. The traction device of claim 8, wherein the plurality of flat portions extend laterally from one side of the ground contact perimeter edge to another side of the ground contact perimeter edge.

10. The traction device of claim 1, wherein at least a portion of each shank is made from a plastic material.

11. A traction device for a footwear item, the device comprising:

a first malleable, soft-metal shank;

a second malleable, soft-metal shank coupled to the first malleable, soft-metal shank by an arch plate, each shank having opposing surfaces, the first opposing surface in contact with a sole of the footwear item, the second opposing surface being substantially continuous from front-to-back and from side-to-side, wherein each malleable, soft-metal shank is slightly deformable when in contact with minor terrain irregularities, and wherein each shank does not have any projections that extend downwardly from each shank as to substantially interfere with the each shank conformably gripping the terrain, and wherein each shank comprises a ground contact perimeter edge that extends laterally around the entire perimeter of the shank for gripping the terrain about the ground contact perimeter edge, and wherein each shank includes a plurality of grooves extending laterally from one side of the ground contact perimeter edge to another side of the ground contact perimeter edge; and a binding system coupled to each shank, the binding system adjustably securable to the footwear item.

12. The traction device of claim 11, further comprising at least one bracket coupled to each shank.

13. The traction device of claim 11, wherein the ground contact perimeter edge comprises a plurality of side edge surfaces defining the ground contact perimeter edge of the shank.

14. The traction device of claim 11, wherein the first shank is a heel shank.

15. The traction device of claim 11, wherein the second shank is a toe shank.

16. The traction device of claim 11, wherein the arch plate is a connecting member secured to each of the first shank and the second shank.

17. The traction device of claim 11, wherein each shank is configured to operate in a linear elastic range.

18. The traction device of claim 11, wherein the binding system is a step-in binding system.

19. The traction device of claim 11, wherein the binding system is a hybrid binding system.

20. The traction device of claim 11, wherein the binding system is a strap binding system.

21. The traction device of claim 11, wherein each shank is made from a non-heat treated material.

22. The traction device of claim 21, wherein the non-heat treated material is an aluminum alloy.

23. The traction device of claim 11, wherein each shank is made from a rubber material embedded with soft metal particulate.

24. The traction device of claim 11, wherein at least a portion of each shank is made from a copper alloy material.

25. A sole of a footwear item, the sole comprising:

a sole of a footwear item;

a first bar removably secured to the sole and having a first surface in contact with the sole and a first ground contact surface made from a malleable, soft-metal material, the first ground contact surface being planar along the entire surface of the first ground contact surface, the first bar comprising a first ground contact perimeter edge that extends laterally around the entire perimeter of the first bar for gripping the terrain about the first ground contact perimeter edge;

a second bar removably secured to the sole and having a first surface in contact with the sole and a second ground contact surface made from a malleable, soft-metal material, the second ground contact surface being planar along the entire surface of the second ground contact surface, wherein the first and second bars are spaced apart along the sole from each other such that a portion of the sole is disposed between the first bar and the second bar, the second bar comprising a second ground contact perimeter edge that extends laterally around the entire perimeter of the second bar for gripping the terrain about the second ground contact perimeter edge, wherein the malleable, soft-metal material is slightly deformable when in contact with minor terrain irregularities, and wherein the first and second bars do not have any projections that extend downwardly from the generally flat first ground contact surfaces of the first and second bars as to substantially interfere with the bottom of the first and second bars conformably gripping the terrain; and fastening devices secured to the first and second bars and to the sole of the footwear item such that the fastening devices extend into the sole of the footwear item, wherein the fastening devices are removable such that the first and second bars are removable and replaceable.

26. The sole of claim 25, wherein the first and second bars are made entirely from the malleable, soft-metal material.

27. The sole of claim 25, wherein the first and second bars are each longitudinally parallel to each other.

28. The sole of claim 25, wherein the first bar is secured to a heel portion of the sole and the second bar is secured to a toe portion of the sole.

29. The sole of claim 25, further comprising a plurality of bars removably secured to the sole and spaced apart from each other along the sole.

30. The sole of claim 25, wherein the first ground contact perimeter edge comprises a uniformly flat surface along the entire surface area of the first ground contact perimeter edge.

31. The sole of claim 30, wherein each uniformly flat surface is substantially parallel to a planar surface of the sole.

32. The sole of claim 31, wherein each uniformly flat surface extends from one side of the sole laterally to another side of the sole.

33. The sole of claim 25, wherein the first and second bars are each longitudinally parallel to each other.

34. A sole comprising:

a sole of a footwear item having a generally planar surface;

a plurality of bars each removably fastened to the sole by fasteners that extend into the sole of the footwear item, wherein the fasteners are removable such that each bar is removable and replaceable, and each bar spaced apart from each other along the sole such that a portion of the sole is disposed between adjacent bars, each bar having a first surface in contact with the sole and a first ground contact surface made from a malleable, soft-metal material; and wherein the malleable, soft-metal material is slightly deformable when in contact with minor terrain irregularities, wherein each bar does not have any projections that extend downwardly from the first ground contact surface as to substantially interfere with the bottom of each bar conformably gripping the terrain, wherein each first ground contact surface comprises a uniformly flat surface along the entire surface area of the first ground contact surface, wherein the uniformly flat surface is substantially parallel to the generally planar surface of the sole, and wherein each bar comprises a ground contact perimeter edge that extends laterally around the entire perimeter of the bar for gripping the terrain about the ground contact perimeter edge.

35. The sole of claim 34, wherein the uniformly flat surface of each bar extends from one side of the sole laterally to another side of the sole.

36. The sole of claim 35, wherein each bar is longitudinally parallel to other bars.

37. The sole of claim 36, wherein the plurality of bars comprises two bars secured to a heel portion of the sole, and comprises three bars secured to a toe portion of the sole.

38. The sole of claim 35, wherein each uniformly flat surface is defined by the entire perimeter of the ground contact perimeter edge of the respective bar.

39. The sole of claim 34, wherein the sole is either formed with a footwear item or removably coupled to the footwear item.

40. A sole comprising:

a sole of a footwear item;

a plurality of members each removably fastened to the sole by fasteners that extend into the sole of the footwear item, wherein the fasteners are removable such that each member is removable and replaceable, and each member spaced apart from each other along the sole such that a portion of the sole is disposed between adjacent members, each member having a first surface in contact with the sole and a first ground contact surface made from a malleable, soft-metal material; and wherein the malleable, soft-metal material surface is deformable when in contact with minor terrain irregularities, wherein each member does not have any projections that extend downwardly from the first ground contact surface as to substantially interfere with the bottom of each member conformably gripping the terrain, and wherein each member comprises a ground contact perimeter edge that extends laterally around the entire perimeter of the member for gripping the terrain about the ground contact perimeter edge.

41. The sole of claim 40, wherein the malleable, soft-metal material comprises non-heat-treated aluminum alloy material, such that each member is soft enough to grip and elastically conform to minor surface irregularities of the terrain.

42. The sole of claim 40, wherein the malleable, soft-metal material comprises non-heat-treated copper alloy material, such that each member is soft enough to grip and elastically conform to minor surface irregularities of the terrain.

43. The sole of claim 40, wherein each first ground contact surface comprises a uniformly flat surface along the entire surface area of the first ground contact surface.

44. The sole of claim 43, wherein each uniformly flat surface is defined by the entire perimeter of the ground contact perimeter edge of the respective member.

* * * * *